US009464377B2

(12) United States Patent
Ziemann

(10) Patent No.: US 9,464,377 B2
(45) Date of Patent: Oct. 11, 2016

(54) MODULAR DRYER

(75) Inventor: Andreas Ziemann, Potsdam (DE)

(73) Assignee: BSH Hausgeräte GmbH, Munich (DE)

( * ) Notice: Subject to any disclaimer, the term of this patent is extended or adjusted under 35 U.S.C. 154(b) by 822 days.

(21) Appl. No.: 12/226,170

(22) PCT Filed: Mar. 13, 2007

(86) PCT No.: PCT/EP2007/052369

§ 371 (c)(1),
(2), (4) Date: Oct. 8, 2008

(87) PCT Pub. No.: WO2007/118742

PCT Pub. Date: Oct. 25, 2007

(65) Prior Publication Data

US 2009/0158611 A1 Jun. 25, 2009

(30) Foreign Application Priority Data

Apr. 11, 2006 (DE) ..... 10 2006 017 068

(51) Int. Cl.
*D06F 58/20* (2006.01)

(52) U.S. Cl.
CPC ..... *D06F 58/20* (2013.01)

(58) Field of Classification Search
CPC ..... D06F 58/20
USPC ..... 34/72, 73, 76, 77, 595, 603, 604, 607, 34/134, 138, 139, 218, 219
See application file for complete search history.

(56) References Cited

U.S. PATENT DOCUMENTS

| | | | | |
|---|---|---|---|---|
| 2,742,708 | A * | 4/1956 | McCormick | 34/76 |
| 3,032,887 | A * | 5/1962 | Whyte et al. | 34/524 |
| 3,229,382 | A * | 1/1966 | Lambert | 34/538 |

FOREIGN PATENT DOCUMENTS

| | | |
|---|---|---|
| DE | 41 39 588 | 6/1992 |
| EP | 0 163 265 | 12/1985 |
| GB | 2 258 720 | 2/1993 |

OTHER PUBLICATIONS

International Search Report PCT/EP2007/052369.

* cited by examiner

*Primary Examiner* — Jiping Lu
(74) *Attorney, Agent, or Firm* — Nixon & Vanderhye P.C.

(57) ABSTRACT

The invention relates to a dryer which is of modular construction and comprises a process air guide (15, 15') into which a first air conducting element (161) for forming a condensation dryer (1) or a second air conducting element (16') for forming a extraction air dryer (1') may be installed. In the process air guide (15, 15') is formed an insertion region (15*d*, 15*d'*) in which the first (161) or the second air conducting element (16') is arranged, wherein the two air conducting elements (161, 16') are designed compatibly in respect of their insertion in the insertion region (15*d*, 15*d'*), at least in certain regions.

34 Claims, 2 Drawing Sheets

MODULAR DRYER

This application is a U.S. National Phase of International Application No. PCT/EP2007/052369, filed Mar. 13, 2007, which designates the U.S. and claims priority to German Application No. 102006017068.7, filed Apr. 11, 2006, the entire contents of each are hereby incorporated by reference.

BACKGROUND OF THE INVENTION

The invention relates to a tumble-dryer which is of modular construction and comprises a process air guide in which a first air conducting element can be installed for forming a condensation dryer or a second air conducting element for forming an extraction air dryer.

The term "process air guide" covers both a closed process air circuit and an open process air guide. In the case of an extraction air dryer this process air guide is open and the process air is fed into the open after contact with the washing. In the case of a condensation dryer or a circulating air dryer the process air guide is closed and the process air is guided in a closed process air circuit. The process air guide will, in particular, include in the following all the air ducts and components through which process air flows in operation.

DE 42 20 534 A1 discloses a tumble-dryer which can be designed according to both dryer principles that are fundamentally of prior art, namely as a condensation dryer or as an extraction air dryer. If the dryer is designed as a condensation dryer a heat exchanger is arranged in the lower region of the dryer, and if it is designed as an extraction air dryer an air guide is arranged in the lower region, which guide discharges process air via the back of the dryer to the surrounding area. The different designs of this dryer of prior art are conceived independently of each other and have, particularly in the case of the heat exchanger for the condensation dryer and the air guide for the extraction air dryer, very different components which deviate from each other in size and shape. It is therefore also necessary for the further elements of the dryer must be designed differently according to these different variants.

BRIEF SUMMARY OF THE INVENTION

It is therefore the object of this invention to provide a dryer which can be designed in a simple and practical manner either as a condensation dryer or as an extraction air dryer.

A dryer according to the invention is of modular construction and comprises a process air guide in which a first air conducting element can be inserted to form a condensation dryer or a second air conducting element can be inserted to form an extraction air dryer. A common insertion region, in which either the first or second air conducting element is arranged in order to comply with the applicable dryer principle, is formed in the process air guide. Both air conducting elements are designed in such a manner that they are formed so that they are compatible, at least in certain regions, in terms of their installation in this installation region provided.

A dryer may therefore be provided which can be designed simply and practically either as a condensation dryer or as an extraction air dryer. For this purpose essentially only one central element, the air conducting element, is replaceable, and the replacement is carried out quickly and simply due to the compatibility of these two air conducting elements. A much lower development cost than is required for two separate concepts can be achieved, not least because of this compatible modular construction. In addition, the installation of an air conducting element in the installation region is in practice made possible with the same tools and the positioning and arrangement of each air conducting element are essentially the same for both.

The two air conducting elements are preferably each designed compatibly in terms of their insertion in the insertion region. Regardless of which air conducting element is therefore inserted, in particular installed, in the insertion region, the insertion region may therefore remain unchanged. At least one end region of each of the two air conducting elements is therefore designed with such a similarity or equality that it can be mounted on or fitted to an unmodified region of the process air guide. The air conducting elements may therefore be installed with a reduced number of components.

The first air conducting element is preferably designed as a heat exchanger, thereby enabling the condensation dryer to be constructed. The process air escaping from the heat exchanger may preferably be conducted via the process air guide to a process air fan. The process air can then be fed on into a drum or a container for receiving articles to be washed by means of this process air fan.

The second air conducting element is preferably designed as an extraction air guide, enabling an extraction air dryer to be constructed in this design. The extraction air guide is preferably arranged so that it leads or opens directly into the area surrounding the dryer with one end.

In a preferred manner the extraction air guide comprises a main duct and a secondary duct, the secondary duct branching from the main duct, and both ducts opening into the area surrounding the dryer. This provides improved discharge of the process air from the dryer.

The main duct and the secondary duct preferably open into the surrounding area on different sides of the dryer. This guarantees at all times safe, reliable discharge of the process air almost independently of the erection of the dryer. Therefore provision may preferably be made for one of the two ducts to open into the surrounding area on one rear side of the dryer and for the second duct to open into the surrounding area on a lateral wall of the dryer. If the dryer is then positioned relatively close to a wall, for example with its rear wall, safe discharge of the process air can then be achieved via the duct which opens into the surrounding area from the lateral wall.

The extraction air guide is preferably designed in one piece. Provision can be made here for the extraction air guide to be formed of plastic, at least in certain regions. If it is formed completely as a plastic component, it may preferably be provided as an injection moulding, thereby guaranteeing low cost production.

Preferably at least the main duct is designed in tapered fashion. The tapering is preferably achieved in such a manner that the end of the extraction air guide opening into the surrounding area has a smaller diameter than the end which is mounted on corresponding elements of the process air guide.

The situation-dependent installed air conducting element is preferably arranged in a bottom group of the dryer.

In the dryer according to the invention essentially only one component, the air conducting element, is replaced and a condensation dryer or an extraction air dryer is therefore provided. On the basis of a condensation dryer in which the air conducting element is designed as a heat exchanger, an extraction air dryer can be formed by simply replacing this with the extraction air guide. All further adaptations are made by omitting components no longer required for the extraction air dryer, such as the cooling air wheel and condensate pump. All the essential components, and particularly the bottom group, therefore remain essentially unchanged.

BRIEF DESCRIPTION OF THE DRAWINGS

Exemplary embodiments of the invention are explained in greater detail in the following with reference to diagrammatic drawings, in which.

The same or functionally similar elements are provided in the figures with the same reference symbols.

DETAILED DESCRIPTION OF THE PRESENT INVENTION

Figure 1:
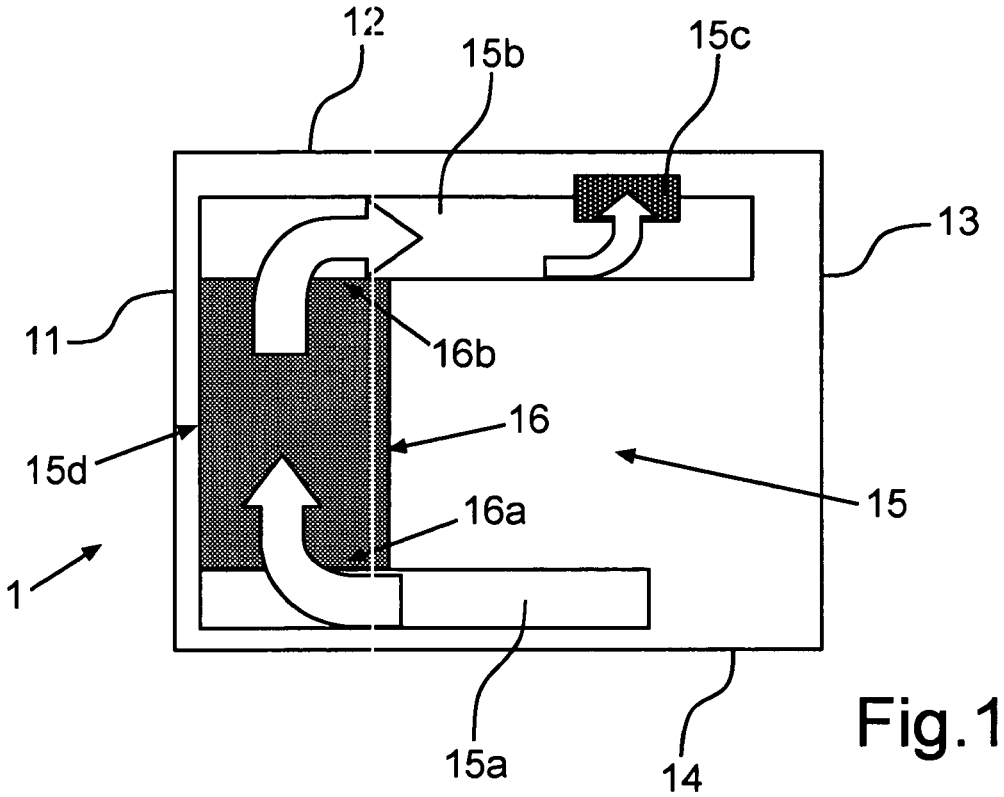
FIG. 1 shows a diagrammatic representation of a dryer which is designed as a condensation dryer.

FIG. 1 shows a diagrammatic elevation of a dryer which is designed as condensation dryer 1. Condensation dryer 1 has a first lateral wall 11, a rear side 12, a second lateral wall 13 and a front side 14. In condensation dryer 1 is arranged a process air guide 15 which is designed as process air circuit 15. Process air is therefore guided in the circuit and flows through a container, not shown (according to normal practice a rotatable drum), in which articles to be washed are placed for drying. Process air circuit 15 has an end plate 15*a* which is arranged adjacent to front side 14 and, according to normal practice, has a front bearing (not shown) for the container designed as a rotatable drum. It also forms a duct-like part of process air guide 15 for discharging the process air escaping from the container with the articles to be washed. The process air flowing through end plate 15*a* is fed into a heat exchanger 161 (FIG. 3) of a heat exchanger system 16, which exchanger is designed to dehumidify the process air. Heat exchanger 161 is connected to a further duct-like element 15*b* of process air circuit 15 in order to guide the process air in a circuit, a process air fan 15*c* also being arranged through which the process air is in turn conveyed to the container. In the process air guide and process air circuit 15 is formed an installation region 15*d* in which heat exchanger 161 is inserted, in particular installed. In the construction of condensation dryer 1 heat exchanger system 16, particularly heat exchanger 161, is coupled with a first end 16*a* for process air guidance to end plate 15*a*, and with a second end 16*b* is coupled to element 15*b*.

Figure 2:
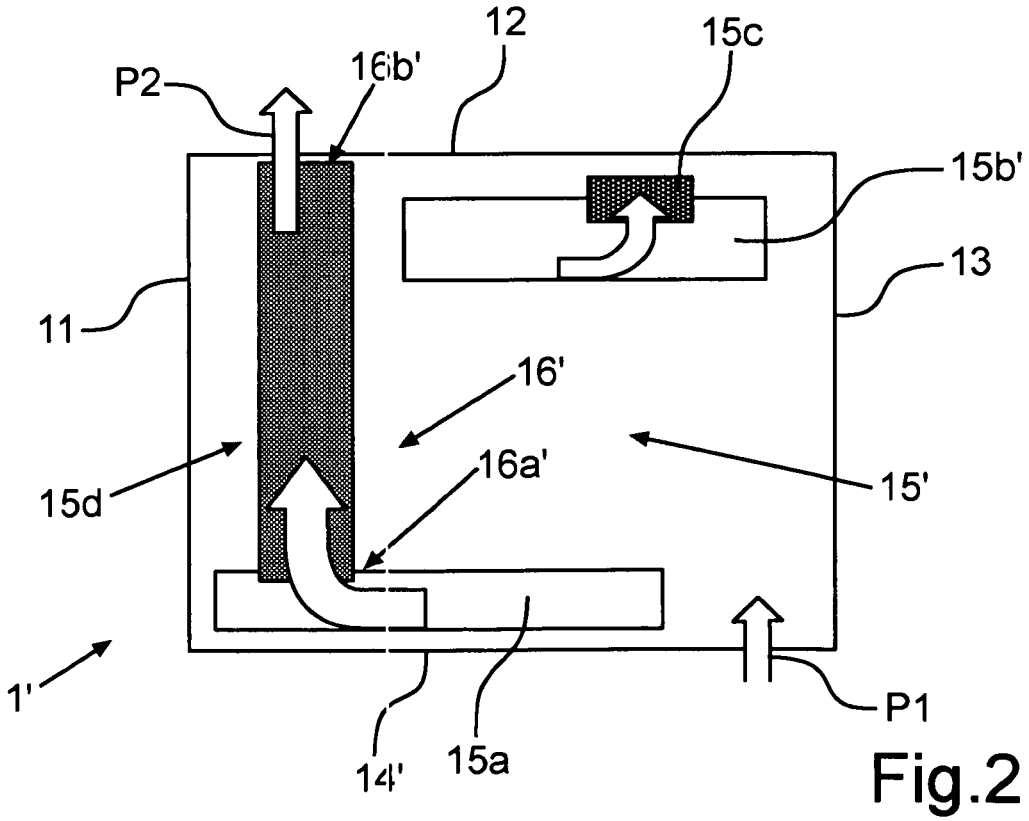
FIG. 2 shows a diagrammatic representation of a dryer which is designed as an extraction air dryer.

Condensation dryer 1 shown diagrammatically in FIG. 1 can be converted simply and practically to an extraction air dryer 1', as shown diagrammatically in FIG. 2. As can be seen here, only replaceable heat exchanger 161, designed as an air conducting element, is replaced by a second air conducting element, characterised by extraction air guide 16'. This diagrammatically shown extraction air guide 16' is also arranged in the essentially unchanged installation region 15*d*. The first air conducting element, in the form of heat exchanger 161, and the second air conducting element in the form of extraction air guide 16', are in this case designed so that they can be arranged in the one installation region 15*d*, and are designed compatibly in terms of their installation there. In particular, the first end 16*a* of heat exchanger system 16 and the first end 16*a'* of extraction air guide 16', are here designed so that they can be joined together with an essentially exact fit with the unchanged installation region 15*b* and, in particular, the unchanged end plate 15*a*.

Because of the design as an extraction air dryer 1', the process air is discharged via the second end 16*b'* of extraction air guide 16' to the area surrounding extraction air dryer 1'. This is denoted by arrow P2. According to arrow P1, the supply air is fed to discharge air dryer 1'. Process air guide 15' of extraction air dryer 1' also has, among other things, end plate 15*a*, as well as element 15*b'* and process air fan 15*c*.

Figure 3:
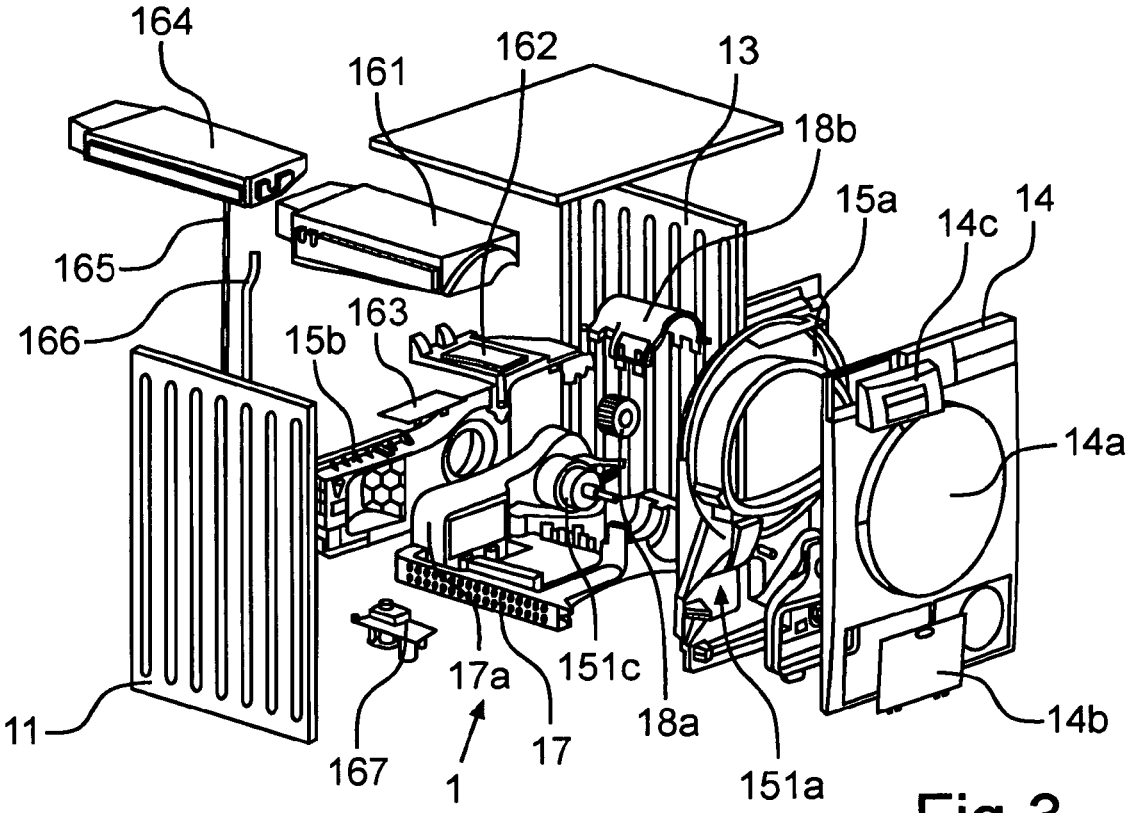
FIG. 3 shows an explosive view of an exemplary embodiment of a condensation dryer.

FIG. 3 shows an exploded view of condensation dryer 1, with the essential elements in respect of this explanation. In addition to lateral walls 11 and 13, front side 14 is shown with a feed door 14*a*. Front side 14 also comprises a flap 14*b* and an insert 14*c*. Access to a lint filter, not shown, is gained via flap 14*b*.

End plate 15*a* comprises, in the lower region, an opening 151*a* through which the process air escaping from the container, not shown, is conducted to heat exchanger system 16. This heat exchanger system 16 has heat exchanger 161 and retaining elements 162 and 163. Retaining element 162 here forms part of first end 16*a* of heat exchanger system 16, and is provided for installation on, or for the mechanical connection to end plate 15*a*.

In addition, heat exchanger system 16 has a condensate container 164, and a first pipe 165 is also shown which is provided for pumping a condensate into condensate container 164. A further pipe 166 is designed as a return pipe for a condensate. Furthermore, a condensate pump 167 is shown in the representation. Condensation dryer 1 further comprises a bottom group which, among other things, comprises a component 17 and element 15*b*. A motor 151*c*, which is designed to drive a fan impeller 18*a*, is arranged in component 17. Fan impeller 18*a* and motor 151*c* are covered by a cover 18*b*.

Figure 4:
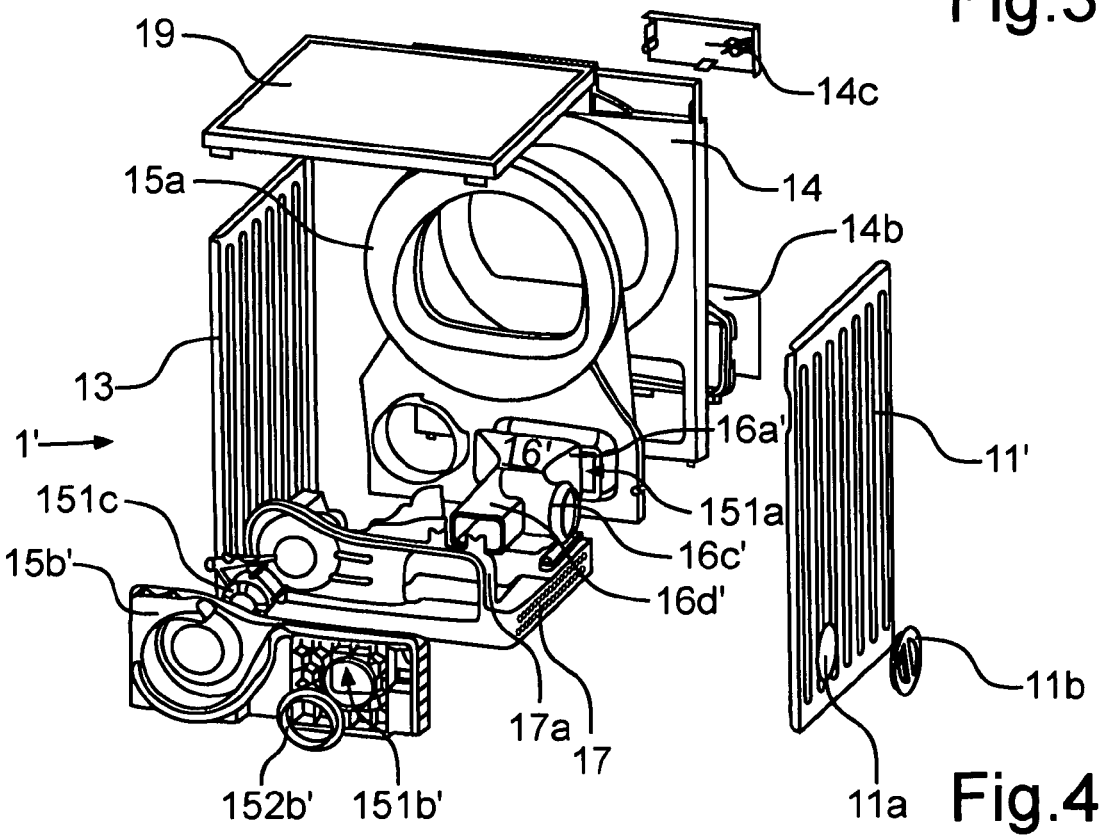
FIG. 4 shows an exploded view of an exemplary embodiment of an extraction air dryer.

FIG. 4 shows an exploded representation of extraction air dryer 1' in a view from behind. As can be seen here heat exchanger system 16 is replaced there by extraction air guide 16', which is positioned in installation region 15*d*. Extraction air guide 16' is designed, in the exemplary embodiment, as an integral plastic element. As can be seen, first end 16*a'* is designed in the shape of a funnel for fitting or installing in installation region 15*d*. Here this first end 16*a'* is designed so that it is compatible with heat exchanger system 16 and, in particular, with support 162 of heat exchanger 161, and can be installed on end plate 15*a* in the region of opening 151*a*. As can also be seen, extraction air guide 16' has a main duct 16*d'* and a secondary duct 16*c'*, which branches from main duct 16*d'*. Main duct 16*d'* and secondary duct 16*c'* are in this case designed so that their openings for discharging the process air to the area surrounding extraction air dryer 1' emerge on different sides of this extraction air dryer 1'. In the exemplary embodiment extraction air guide 16' is designed and arranged in installation region 15*d* so that process air is able to escape from rear side 12 via main duct 16*d'*. For this purpose an opening 151*b'* is formed in element 15*b'*. An annular retaining element 152*b'*, which allows fastening to rear wall 12 of element 15*b'*, is arranged on the side of element 15*b'* facing away from component 17. Component 17 has an opening 17*a* through which main duct 16*d'* is guided, and extraction air guide 16' can therefore be arranged and retained with positional accuracy.

Secondary duct 16*c*' extends laterally and opens from lateral wall 11' into the area surrounding extraction air dryer 1'. For this purpose an opening 11*a* is formed in this lateral wall 11'. If this discharge via secondary duct 16*c*' is not required, opening 11*a* can be covered by a covering element 11*b*.

As can also be seen in FIG. 4, extraction air guide 16' is designed so that it is tapered from first end 16*a*', particularly in the region of main duct 16*d*', as far as second end 16*b*'.

Extraction air guide 16' and heat exchanger 161, in particular with its retaining elements 162 and 163, are designed so that they are compatible in terms of installation in installation region 15*d*. Because of the replacement by the essentially one central element, heat exchanger 161, on the one hand, and extraction air guide 16' on the other, a corresponding functional principle of dryer 1 or 1' may therefore be fulfilled, dependent on this. Neither the fitting of these elements on end plate 15*a* nor their installation in component 17, need be modified in this case.

FIG. 4 also shows a working plate 19 as the upper cover.

In particular, the mechanical fastening of first ends 16*a*' and 16*a* of components 16' and 16 respectively may be connected with an exact fit to end plate 15*a*, and here a releasable connection may be provided in the form of clamps. However, a screw connection or the like, or a plug connection, may also be provided.

In comparing condensation dryer 1 with extraction air dryer 1', parts 161 to 167 and fan impeller 18*a*, on the basis of the representation in FIG. 3, may be removed for feeding cooling air to heat exchanger 161 as well as to cover 18*b*. These parts are no longer required for constructing extraction air dryer 1' according to FIG. 4. Instead of these parts mentioned, parts 16', 14*b*, 14*c*', 152*b*' and optionally 11*b*' may be arranged in extraction air dryer 1' according to FIG. 4. In particular, parts 15*b* and 15*b*', and parts 115*c* and 11 and 11' respectively, are then provided in a modified design dependent on the variant constructed.

The invention claimed is:

1. A dryer comprising:

a compartment in which an item to be dried is retained;

a process air guide assembly having an insertion region configured to alternatively receive therein a first air conducting element for forming a condensation dryer and a second air conducting element for forming an extraction air dryer, the process air guide assembly comprising a member that supports a motor and includes an opening through which process air is conducted and that is configured to alternatively interface with the first air conducting element and the second air conducting element; and a selected one of the first air conducting element for forming a condensation dryer or a second air conducting element for forming an extraction air dryer disposed in the insertion region, wherein both the first and second air conducting elements are compatibly configured with respect to the insertion region, wherein the member is configured to selectively receive a third air conducting element adapted to mate with the member to form a recirculation path of the condensation dryer and a fourth air conducting element adapted to mate with the member to form an extraction path of the extraction dryer, the third air conducting element being selected when the first air conducting element is selected and the fourth air conducting element being selected when the second air conducting element is selected.

2. The dryer according to claim 1, wherein the first and second air conducting elements has at least one end portion that is compatibly configured with respect to a corresponding component of the dryer in the insertion region.

3. The dryer according to claim 1, wherein the first air conducting element is configured as a heat exchanger for configuring the dryer as a condensation dryer.

4. The dryer according to claim 3, wherein the process air guide assembly is configured to conduct process air escaping from the heat exchanger to a process air fan.

5. The dryer according to claim 1, wherein the second air conducting element is configured as an extraction air guide for configuring the dryer as an extraction dryer.

6. The dryer according to claim 5, wherein the extraction air guide leads directly into the area surrounding the dryer.

7. The dryer according to claim 5, wherein the extraction air guide has a main duct and a secondary duct that branches from the main duct and both ducts open into the area surrounding the dryer.

8. The dryer according to claim 7, wherein the main duct and secondary duct open on different sides of the dryer into the surrounding area.

9. The dryer according to claim 8, wherein the extraction air guide is of an integral design.

10. The dryer according to claim 8, wherein the main duct is of a tapered design.

11. The dryer according to claim 1, wherein the respective one of the first and second air conducting elements is arranged in a bottom group of the dryer.

12. A dryer having:

a compartment in which an item to be dried is retained;

a process air guide assembly having a common insertion and installation region and comprising a member that supports a motor and includes an opening through which air is conducted;

a first air conducting element for forming a condensation dryer;

a second air conducting element for forming an extraction air dryer;

wherein each of the first and second air conducting elements has one or more portions that are compatible with the common insertion and installation region and that interface with the opening such that the insertion and installation region remains essentially unchanged regardless of whether the first or the second air conducting element is engaged and operatively received in the insertion and installation region; and a third air conducting element adapted to mate with the member to form a recirculation path of the condensation dryer and a fourth air conducting element adapted to mate with the member to form an extraction path of the extraction dryer, wherein the third air conducting element and the fourth air conducting element mate with a same portion of the member.

13. The dryer according to claim 12, wherein each of the first and second air conducting elements includes at least a portion to form an exact fit with the common insertion and installation region.

14. The dryer according to claim 12, wherein the dryer includes an end plate and a bottom group component that together define at least part of the common insertion and installation region, and at least one of the end plate and the bottom group component is structured in essentially the same fashion regardless of whether the first or second air conducting element is operatively connected to the process air guide.

15. The dryer according to claim 14, wherein both the end plate and the bottom group component are configured in the same fashion regardless of whether the first or second air conducting element is operatively connected to the process air guide.

16. The dryer according to claim 14, wherein the end plate includes a front bearing to rotatably support the compartment, and an opening for discharging process air escaping from the compartment, said opening being structured to exactly fit with an end of either the first or second air conducting element.

17. The dryer according to claim 14, wherein the bottom group component includes an upper support surface to support either the first or second air conducting element, and a motor supported by an upstanding member extending from the upper support surface.

18. A dryer comprising a compartment in which an item to be dried is retained;

air conducting componentry in the form of condensation dryer componentry or extraction dryer componentry;

a process air guide assembly including a member that supports a motor and includes an opening through which air is conducted to form part of a common insertion and installation region structured and configured to form an exact fit with the condensation dryer componentry and the extraction dryer componentry, whereby the insertion and installation region remains essentially unchanged regardless of whether the condensation dryer componentry or the extraction dryer componentry is engaged with and operatively received in the insertion and installation region; and additional air conducting componentry in the form of additional condensation dryer componentry or additional extraction dryer componentry, wherein the additional air conducting componentry mates with the member on a side of the member opposite the opening.

19. The dryer according to claim 18, wherein the dryer includes an end plate and a bottom group component that together define at least part of the common insertion and installation region, and at least one of the end plate and the bottom group component is structured in essentially the same fashion regardless of whether the condensation dryer componentry or the extraction dryer componentry is operatively connected to the process air guide.

20. The dryer according to claim 19, wherein both the end plate and the bottom group component are configured in the same fashion regardless of whether the condensation dryer componentry or the extraction dryer componentry is operatively connected to the process air guide.

21. The dryer according to claim 19, wherein the end plate includes a front bearing to rotatably support the compartment, and an opening for discharging process air escaping from the compartment, said opening being structured to exactly fit with an end of either the condensation dryer componentry or the extraction dryer componentry.

22. The dryer according to claim 21, wherein the bottom group component includes an upper support surface to support either the condensation dryer componentry or the extraction dryer componentry, and a motor supported by an upstanding member extending from the upper support surface.

23. A method of manufacturing a dryer having a compartment in which an item to be dried is retained and a process air guide assembly, the method comprising:

providing a first air conducting element for forming a condensation dryer;

providing a second air conducting element for forming an extraction air dryer;

forming the process air guide with a common insertion and installation region including a member that supports a motor and that includes an opening through which process air is conducted;

configuring the first and second air conducting elements to be compatible with the common insertion and installation region, including the opening, such that the insertion and installation region remains essentially unchanged regardless of whether the first or the second air conducting element is engaged and operatively received in the insertion and installation region;

inserting only a selected one of the first and second air conducting elements into operative engagement with the common insertion and installation region;

providing a third air conducting element for forming the condensation dryer;

providing a fourth air conducting element for forming the extraction air dryer;

further forming the member with an interface adapted to mate with the third air conducting element and the fourth air conducting element, the interface being formed on a side of the member opposite to the opening; and attaching only a selected one of the third and fourth air conducting elements to the member to provide an air path communicating with the opening.

24. The method according to claim 23, further comprising: forming at least a portion of the first and second air conducting elements to form an exact fit with the common insertion and installation region.

25. The method according to claim 23, wherein the dryer includes an end plate and a bottom group component that together define at least part of the common insertion and installation region, and the method further comprises configuring at least one of the end plate and the bottom group component in essentially the same fashion regardless of whether the first or second air conducting element is operatively connected to the process air guide.

26. The method according to claim 25, wherein both the end plate and the bottom group component are configured in the same fashion regardless of whether the first or second air conducting element is operatively connected to the process air guide.

27. The method according to claim 25, wherein the end plate includes a front bearing to rotatably support the compartment, and an opening for discharging process air escaping from the compartment, said opening being structured to exactly fit with an end of either the first or second air conducting element.

28. The method according to claim 25, Wherein the bottom group component includes an upper support surface to support either the first or second air conducting element, and a motor supported by an upstanding member extending from the upper support surface.

29. A method of manufacturing a dryer having a compartment in which an item to be dried is retained and a process air guide assembly, the method comprising:

forming the process air guide with a member that supports a motor and includes an opening through which process air is conducted and a common insertion and installation region, the opening forming part of the common insertion and installation region;

configuring the common insertion and installation region to be compatible with first and second different types of air conducting elements;

fitting only a selected one of the first and second air conducting elements into operative engagement with the common insertion and installation region, wherein a portion of the insertion and installation region onto which the first or the second air conducting element is affixed is unmodified regardless of whether the first or second air conducting element is selected;

configuring the member with an interface on a side opposite the opening that is compatible with third and fourth different types of air conducting elements; and fitting only a selected one of the third and fourth air conducting elements into operative engagement with the interface.

30. The method according to claim 29, further comprising: forming at least a portion of the first and second air conducting elements to form an exact fit with the common insertion and installation region.

31. The method according to claim 29, wherein the dryer includes an end plate and a bottom group component that together define at least part of the common insertion and installation region, and the method further comprises configuring at least one of the end plate and the bottom group component in essentially the same fashion regardless of whether the first or second air conducting element is operatively connected to the process air guide.

32. The method according to claim 31, wherein both the end plate and the bottom group component are configured in the same fashion regardless of whether the first or second air conducting element is operatively connected to the process air guide.

33. The method according to claim 31, wherein the end plate includes a front bearing to rotatably support the compartment, and an opening for discharging process air escaping from the compartment, said opening being structured to exactly fit with an end of either the first or second air conducting element.

34. The method according to claim 31, wherein the bottom group component includes an upper support surface to support either the first or second air conducting element, and a motor supported by an upstanding member extending from the upper support surface.

* * * * *